United States Patent [19]

Hinzmann

[11] Patent Number: 4,620,552

[45] Date of Patent: Nov. 4, 1986

[54] METHOD AND APPARATUS FOR MAKING AND MANIPULATING STREAMS OF FIBROUS MATERIAL

[75] Inventor: Alfred Hinzmann, Weams, Va.

[73] Assignee: Hauni-Werke Körber & Co. KG., Hamburg, Fed. Rep. of Germany

[21] Appl. No.: 743,672

[22] Filed: Jun. 11, 1985

[51] Int. Cl.[4] ..... A24C 5/18

[52] U.S. Cl. ..... 131/84.3; 131/78; 131/84.1; 493/48; 198/689.1; 198/839

[58] Field of Search ..... 131/84.1, 84.3, 77, 131/78, 84.4; 493/42, 47, 48; 198/839, 689.1, 405

[56] References Cited

U.S. PATENT DOCUMENTS

| | | | |
|---|---|---|---|
| 2,732,058 | 1/1956 | Nigra et al. | 198/839 |
| 4,122,859 | 10/1978 | Preston | 131/84.3 |
| 4,207,907 | 6/1980 | Dyett | 131/84.3 |
| 4,564,026 | 1/1986 | Wahle et al. | 131/84.3 |

FOREIGN PATENT DOCUMENTS

| | | | |
|---|---|---|---|
| 1001979 | 12/1976 | Canada | 198/405 |

*Primary Examiner*—V. Millin
*Assistant Examiner*—H. Macey
*Attorney, Agent, or Firm*—Peter K. Kontler

[57] ABSTRACT

A tobacco stream which is formed at the upper side of one elongated reach of a foraminous endless belt conveyor opposite a suction chamber is inverted upside down by a twisted intermediate portion of the elongated reach so that it adheres to the underside of such reach by suction before it is transferred onto a web of cigarette paper. The elongated reach of the foraminous conveyor is guided in the groove of an elongated channel which has a flat surface upstream, a twisted surface adjacent to and a flat surface downstream of the intermediate portion of the elongated reach, and such surfaces are formed with suction ports to attract the tobacco stream to the elongated reach.

20 Claims, 4 Drawing Figures

METHOD AND APPARATUS FOR MAKING AND MANIPULATING STREAMS OF FIBROUS MATERIAL

CROSS-REFERENCE TO RELATED APPLICATION

The belt conveyor which is used in the apparatus of the present invention is similar to the belt conveyor which is disclosed in the commonly owned copending patent application Ser. No. 672,585 filed Nov. 16, 1984 for "Foraminous belt conveyor".

BACKGROUND OF THE INVENTION

The present invention relates to a method of and to an apparatus for making and/or manipulating streams of tobacco, filter material for tobacco smoke and other types of fibrous material. More particularly, the invention relates to improvements in a method of and in an apparatus for making and/or manipulating streams of fibrous material in machines which can be utilized with particular advantage for the production of rod-shaped smokers' products. Still more particularly, the invention relates to the making and/or manipulating of streams of fibrous material preparatory to further processing of the streams, especially preparatory to draping of such streams into running webs of cigarette paper, tipping paper, artificial cork and/or like wrapping material.

It is known to build a stream of comminuted tobacco, such as a stream of tobacco shreds, in a cigarette making machine by directing tobacco particles against one side of a moving endless foraminous belt conveyor the other side of which advances along a suction chamber so that the one side attracts the particles and causes them to form a tobacco stream. The fully grown stream is thereupon trimmed or equalized (i.e., the surplus is removed therefrom) prior to draping the resulting rod-like filler into a web of cigarette paper or the like so that the web and the filler form a continuous rod which is thereupon subdivided into plain cigarettes of unit length or multiple unit length. The particles are supplied by the distributor of the cigarette making machine, often in the form of a shower whose particles ascend toward the underside of the lower reach of the belt conveyor. The lower reach of the belt conveyor is caused to advance in a channel which is flanked by two downwardly extending sidewalls and by a perforated top wall which forms part of a suction chamber and is adjacent to the upper side of the lower reach. The suction chamber ensures that the ascending particles (such as tobacco shreds) adhere to the underside and travel with the lower reach of the belt conveyor toward the trimming or equalizing station and thereupon to the station where the trimmed stream (i.e., the filler) is transferred onto a running web of wrapping material at or ahead of a wrapping station.

The building of a tobacco stream at the underside of the lower reach of a foraminous belt conveyor is desirable on the ground that the filler (trimmed stream) can be conveniently deposited on the running web of wrapping material at or immediately ahead of the wrapping station. On the other hand, the building of the stream at the underside of the lower reach of a foraminous belt conveyor also presents problems because the particles of fibrous material must be propelled upwardly by streams of compressed air, by mechanical propelling means and/or by suction. Reference may be had to commonly owned U.S. Pat. No. 4,175,570 to Heitmann and/or to commonly owned U.S. Pat. No. 4,185,644 to Heitmann et al. If the stream of fibrous material is formed in the circumferential groove of a suction wheel (see, for example, the disclosure of the commonly owned U.S. Pat. No. 4,004,593 to Kaeding et al.), the fully grown stream must be transferred to the underside of the lower reach of a foraminous belt conveyor prior to transfer onto the upper side of the running web of wrapping material. All of the above outlined techniques are costly, complex and entail undesirable and unpredictable deformation of the stream in a manner which can affect the quality of the ultimate product. In many instances, the simplest and most reliable way of forming a continuous stream of tobacco shreds or the like would be to simply shower the particles onto the upper side of the upper reach of a foraminous belt conveyor; however, this presents problems in connection with the transfer of the thus formed stream onto the upper side of a running web of wrapping material because the upper reach of the belt conveyor is disposed below the fully grown stream. In other words, it is presently necessary to transfer the fully grown stream onto a further foraminous belt conveyor in such a way that the tobacco stream is adjacent and adheres to the underside of the further foraminous conveyor ahead of the wrapping station and ahead of the location where successive increments of the stream come in contact with the web of wrapping material. The utilization of a further foraminous belt conveyor downstream of the stream building or growing zone contributes to the length and complexity of the rod making machine and establishes an additional possibility of adversely affecting the appearance, density and/or other desirable characteristics of the stream prior to wrapping.

OBJECTS AND SUMMARY OF THE INVENTION

An object of the invention is to provide a novel and improved method of making a continuous stream of fibrous material (such as shreds of tobacco leaves) in such a way that the fully grown stream can be immediately transferred onto a running web of wrapping material without the utilization of additional or intermediate stream transporting conveyor means.

Another object of the invention is to provide a method which ensures that the fully grown stream of tobacco shreds or the like can be properly and predictably transferred onto a web of wrapping material in immediate or close proximity of the stream growing zone.

A further object of the invention is to provide a method of making and manipulating a continuous stream of fibrous material, particularly a fibrous material which is used for the making of plain or filter tipped cigarettes, cigars or cigarillos, in such a way that the direction of travel of fibrous material need not be changed at any time between the stream building and the stream wrapping stations.

An additional object of the invention is to provide a novel and improved method of manipulating a fully grown stream of tobacco particles or the like in a machine for the making of plain cigarettes, cigars, cigarillos, filter rod sections and like rod-shaped articles which constitute or form part of smokers' products.

Still another object of the invention is to provide a novel and improved method of changing the orientation of a fully grown stream of shredded tobacco or the like without changing the direction of its movement.

A further object of the invention is to provide a method of changing the orientation of a fully grown stream of fibrous material in a small area and in such a way that each and every increment or unit length of the stream as well as each and every stratum of the stream is treated in the same way so that the original consistency of the stream remains unchanged or is altered uniformly as considered in the transverse as well as in the longitudinal direction of the stream.

Another object of the invention is to provide a method which can be utilized for the making and/or manipulation of streams of fibrous material in experimental or laboratory machines as well as in machines for mass production of rod-shaped smokers' products or their constituents.

An additional object of the invention is to provide a novel and improved apparatus for the practice of the above outlined method and to construct and assemble the apparatus in such a way that it can be utilized with advantage in existing types of machines for the production of rod-shaped articles, especially for the production of rod-shaped articles which form part of or constitute smokers' products.

A further object of the invention is to provide the apparatus with novel and improved means for manipulating a freshly grown or built continuous stream of fibrous material.

Another object of the invention is to provide the apparatus with novel and improved means for changing the orientation of a continuous tobacco stream without changing the direction of its movement.

An additional object of the invention is to provide an apparatus which can reliably hold the stream during manipulation so that the stream cannot leave its prescribed path.

Another object of the invention is to provide the apparatus with novel and improved means for inverting a continuous stream of fibrous material.

A further object of the invention is to provide an apparatus which can grow a continuous stream by showering the fibrous material downwardly and which can also deposit successive increments of the fully grown stream onto successive increments of a running web of cigarette paper or other suitable wrapping material without the need to transfer the fibrous material onto one or more additional conveyors between the stream forming and the stream wrapping stations.

Another object of the invention is to provide a novel and improved apparatus for manipulating a continuous stream of fibrous material at the rate which is required in a modern cigarette maker which turns out up to and even well in excess of 8000 plain cigarettes per minute.

An additional object of the invention is to provide the apparatus with novel and improved means for changing the orientation of successive increments of a longitudinally moving stream of fibrous material in a highly predictable way.

One feature of the invention resides in the provision of a method of producing and manipulating a stream of particulate material, especially fibrous material such as a stream of tobacco particles or a stream of fibrous filter material. The method comprises the steps of establishing an elongated path (e.g., by an elongated reach of an endless foraminous belt conveyor), feeding fibrous material into a first portion of the path and advancing the material in a predetermined direction longitudinally of the path so that the material grows into an elongated stream, moving the stream longitudinally of the path in the predetermined direction, and simultaneously twisting successive increments or unit lengths of the moving stream through a predetermined angle into a spiral in a second portion of the path about an axis which extends in the predetermined direction. The second portion of the path is located downstream of the first portion, as considered in the predetermined direction. The angle can deviate from 360 degrees (i.e., the spiral can extend along an arc of less than 360 degrees) so that the orientation of the stream downstream of the second portion of the path then departs from the orientation of the stream upstream of the second portion. The method can further comprise the step of draping the stream into a web of wrapping material (such as cigarette paper) downstream of the second portion of the path.

The feeding step can include delivering fibrous material into the first portion of the path from a level above the first portion, e.g., by showering fibrous material downwardly into the first portion of the path. The aforementioned angle can equal or approximate 180 degrees so that the stream is then inverted upside down as a result of twisting of successive increments or unit lengths in the second portion of the path. Successive increments of the inverted stream are thereupon deposited onto successive increments of the running web of wrapping material downstream of the second portion of the path.

If the making of the stream forms no part of the method, the latter comprises the steps of moving the stream longitudinally along an elongated path in a predetermined direction, and twisting successive increments or unit lengths of the moving stream in a predetermined portion of the path into a spiral through a predetermined angle about an axis which extends in the predetermined direction. The orientation of the stream downstream of the predetermined portion of the path departs from the orientation of the stream upstream of such predetermined portion if the angle deviates from 360 degrees.

Another feature of the invention resides in the provision of an apparatus for producing and manipulating a stream of fibrous or other particulate material, particularly a stream of tobacco shreds and/or otherwise configurated tobacco particles. The apparatus comprises an endless foraminous belt conveyor having an elongated reach (e.g., the lower reach of a relatively narrow air-permeable belt conveyor which is disposed in a substantially vertical plane and whose lower reach is or can be horizontal or nearly horizontal), pulleys or other suitable means for driving the conveyor so that its reach advances in a predetermined direction, means for establishing and maintaining a pressure differential between the opposite sides of the elongated reach (preferably in such a way that the (one) side of the reach where the pressure is higher faces upwardly in the upstream portion of such reach, as considered in the predetermined direction), means for twisting an intermediate portion of the elongated reach into a spiral through a predetermined angle about an axis which extends in the predetermined direction, and means (e.g., an endless belt conveyor or a duct) for feeding fibrous material to the one side of the elongated reach upstream of the intermediate portion so that the fibrous material adheres to the reach due to the establishment of the pressure differential and forms a stream successive increments or unit lengths of which are twisted through the predetermined angle by the intermediate portion of the reach. The twisting means preferably includes an elongated channel or trough for the elongated reach of the belt conveyor, and the pressure differential establishing means preferably includes at least one suction chamber which is provided in the channel adjacent to the other side of the elongated reach. As mentioned above, the one side of the elongated reach preferably faces upwardly upstream of the intermediate portion so that the feeding means can comprise means for supplying fibrous material from above, e.g., by showering the fibrous material onto the one side of the reach upstream of the intermediate portion. The aforementioned angle then preferably equals or approximates 180 degrees so that the stream is inverted upside down during travel with the intermediate portion of the reach.

The apparatus can further comprise a source of web-shaped wrapping material, means for conveying the wrapping material from the source longitudinally of and below the elongated reach downstream of the intermediate portion, and means (e.g., a portion of the aforementioned channel which does not have a suction chamber therein or a pulley) for effecting the transfer of the inverted stream from the elongated reach onto the wrapping material so that the stream and the wrapping material can be converted into a continuous rod having a substantially cylindrical filler of fibrous material and a tubular envelope of wrapping material.

The conveyor preferably further comprises an untwisted second reach and the aforementioned angle preferably equals or approximates 180 degrees. This can be readily achieved by securing the end portions of an elongated foraminous band of finite length to each other subsequent to twisting of one end portion through 180 degrees or subsequent to twisting of each of the end portions through a given angle so that the two angles together equal or approximate 180 degrees.

The channel preferably further includes means for defining the boundaries of the intermediate portion of the elongated reach, preferably with a defined (e.g., readily detectable) transition between such intermediate portion and the neighboring upstream and downstream portions of the elongated reach. The channel can have a spiral surface which is adjacent to and twists the intermediate portion of the elongated reach, and the aforementioned defining means can comprise two substantially flat surfaces which are provided in the channel, which flank the spiral surface and which define with the spiral surface edges extending substantially transversely of the predetermined direction. Each such flat surface can make a predetermined acute angle with the adjacent end portion of the spiral surface. The channel can receive at least the major part of the elongated reach of the foraminous conveyor and the aforementioned suction chamber or chambers are preferably adjacent to such major part of the elongated reach.

If the making of the stream forms no part of the invention (e.g., if the stream is formed ahead of the location of the improved apparatus), the apparatus comprises a transporting unit which defines for the stream an elongated path wherein the stream advances longitudinally in a predetermined direction, and the transporting unit is provided with a spiral portion which twists the advancing stream through a predetermined angle about an axis which extends in the predetermined direction. If the angle deviates from 360 degrees, the orientation of that portion of the stream which is located downstream of the spiral portion of the transporting unit departs from the orientation of the stream upstream of the spiral portion. The transporting unit can comprise an endless foraminous belt conveyor having an elongated reach which defines the elongated path, an elongated channel or trough for the elongated reach, and at least one suction chamber which is provided in the channel adjacent to the elongated reach opposite the stream in the path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
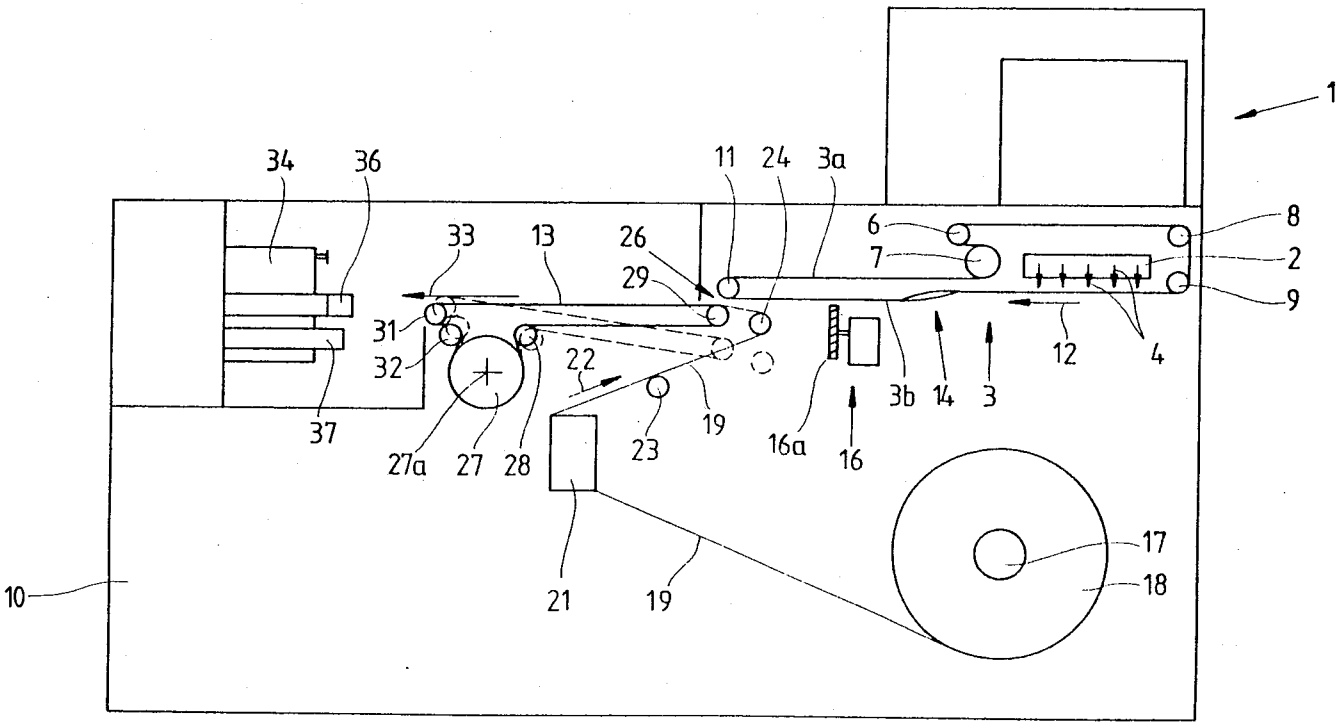
FIG. 1 is a schematic elevational view of a cigarette rod making machine which embodies the improved apparatus.

Referring first to FIG. 1, there is shown a cigarette rod making machine which can be used, for example, in a laboratory for test purposes, i.e., for producing relatively short series of discrete plain cigarettes or unit length or multiple unit length. The machine comprises a distributor 1 which is preferably a so-called gravity type distributor wherein the output element is an endless belt conveyor 2 constituting a means for feeding successive increments of a relatively wide homogenized layer of tobacco shreds 38 (see FIG. 2) onto the upper side of the elongated horizontal or substantially horizontal lower reach **3*b* of an endless foraminous tobacco stream forming and advancing belt conveyor 3. The manner in which the distributor 1 can form a homogeneous layer of tobacco shreds 38 is disclosed, for example, in the aforementioned commonly owned patent to Heitmann et al. The conveyor 2 showers tobacco shreds 38 onto the upstream portion 47 (see FIG. 3) of the lower reach 3*b*, and the conveyor 3 advances the thus deposited shreds in the direction of arrow 12 so that the shreds form a growing stream 39 which is fully grown at a location below a pulley 7 for the conveyor 3. The upper reach of the tobacco feeding conveyor 2 advances toward the observer of FIG. 1, i.e., at right angles to the plane of this drawing, and the directions in which the shreds 38 descend are indicated by the arrows 4**.

Figure 2:
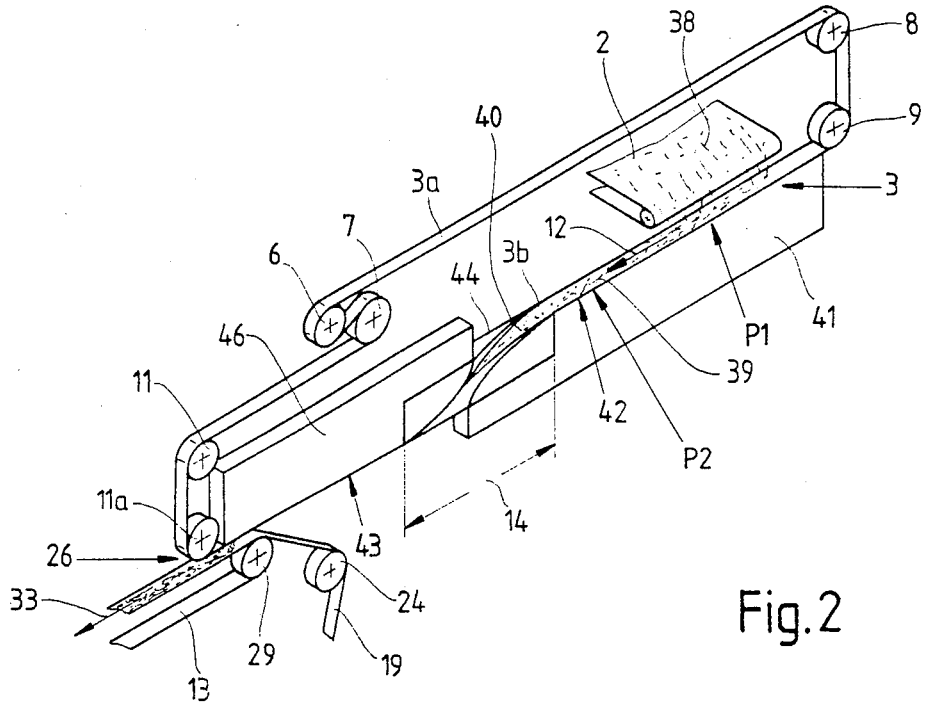
FIG. 2 is an enlarged perspective view of a slightly modified apparatus.

The conveyor 3 is trained over the aforementioned pulley 7 as well as over a set of additional pulleys 6, 8, 9, 11 (FIG. 1) or 6, 8, 9, 11 and **11*a* (FIG. 2). At least one of these pulleys (e.g., the pulley 6) is driven by the main prime mover of the cigarette rod making machine to advance the conveyor 3 in the direction of arrow 12. The lower reach 3*b* has an intermediate portion 14 which is twisted through an angle of 180 degrees or substantially 180 degrees about an elongated horizontal axis which extends in the direction of the arrow 12. This intermediate portion is flanked by the aforementioned upstream portion 47 and a downstream portion 48 (see FIG. 3**).

The cigarette rod making machine comprises a frame 10 which supports the distributor 1, the pulleys for the foraminous belt conveyor 3 and a spindle 17 for a reel 18 constituting a source of convoluted web-shaped wrapping material 19 (e.g., cigarette paper). The means for advancing the web 19 longitudinally along a second path extending at a level below the downstream portion 48 of the lower reach **3*b* of the belt conveyor 3 comprises an endless belt conveyor 13 which is trained over pulleys 27, 28, 29, 31 and 32. The pulley 29 is located downstream (as considered in the direction of the arrow 12) of a trimming station for a preferably adjustable trimming or equalizing device 16 whose cutter 16*a* removes the surplus from successive increments of the moving stream 39 so that the stream is converted into a rod-like filler which is then deposited on the upper side of the web 19 of wrapping material at a level above the upper reach of the conveyor 13. The transfer station 26 for the filler is located between the pulleys 11 and 29 of FIG. 1. The cutter 16*a*** can resemble a milling cutter; however, it is equally possible to employ two so-called pinching discs and a paddle wheel or a brush which is disposed at a level below the substantially horizontal plane of such discs and removes those portions of the shreds which extend downwardly beyond the common plane of the discs.

The web 19 is caused to advance through a conventional imprinting mechanism 21 which is mounted in the frame 10 between the source (reel 18) and the pulley 29. Such web is trained over two rollers 23, 24 and is caused to advance in the direction which is indicated by the arrow 22. The conveyor 13 constitutes a component of a wrapping mechanism which drapes the web 19 around the filler while the web and the filler advance in the direction which is indicated by the arrow 33. The resulting continuous cigarette rod is then severed by a cutoff 34 to yield a file of discrete plain cigarettes of unit length or multiple unit length. A deflector 36 diverts successive plain cigarettes of the file onto a take-off conveyor 37 which delivers the rod-shaped articles to storage (e.g., into a collecting bin if the machine of FIG. 1 is a laboratory type machine) or to the next processing machine (e.g., to a cigarette packing machine) if the machine of FIG. 1 is used for mass-production of plain cigarettes. The conveyor 37 is designed to advance discrete plain cigarettes in a direction at right angles to the plane of FIG. 1.

The entire wrapping mechanism, or at least the conveyor 13, is preferably pivotable about the axis **27*a* of the pulley 27 so as to facilitate cleaning of the wrapping mechanism and/or to enable the machine to wrap tobacco fillers having different diameters. For example, the conveyor 13 can be pivoted between the solid-line position and the broken-like position of FIG. 1. The roller 24 for the web 19 of wrapping material can share such pivotal movements of the conveyor 13. The manner in which one of the pulleys for the conveyor 13 and the spindle 17 for the reel 18 are driven when the machine of FIG. 1 is in actual use is not specifically shown in the drawing. The spindle 17 and one of the pulleys for the conveyor 13** can receive motion from the aforementioned main prime mover (e.g., a variable-speed electric motor) of the cigarette rod making machine.

Figure 3:
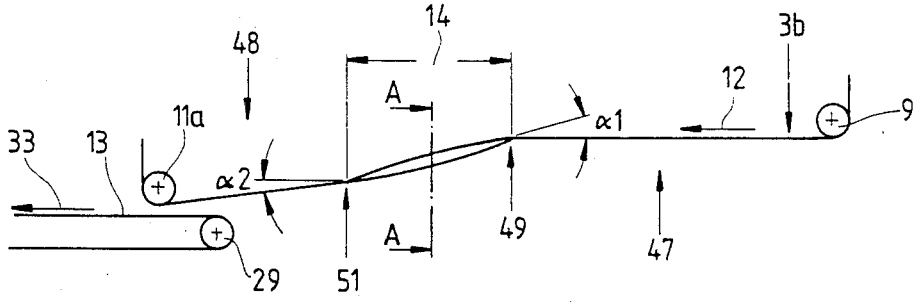
FIG. 3 is a schematic side elevational view of the stream twisting station and of the adjacent portions of the elongated reach of the foraminous stream forming and advancing belt conveyor.
Figure 4:
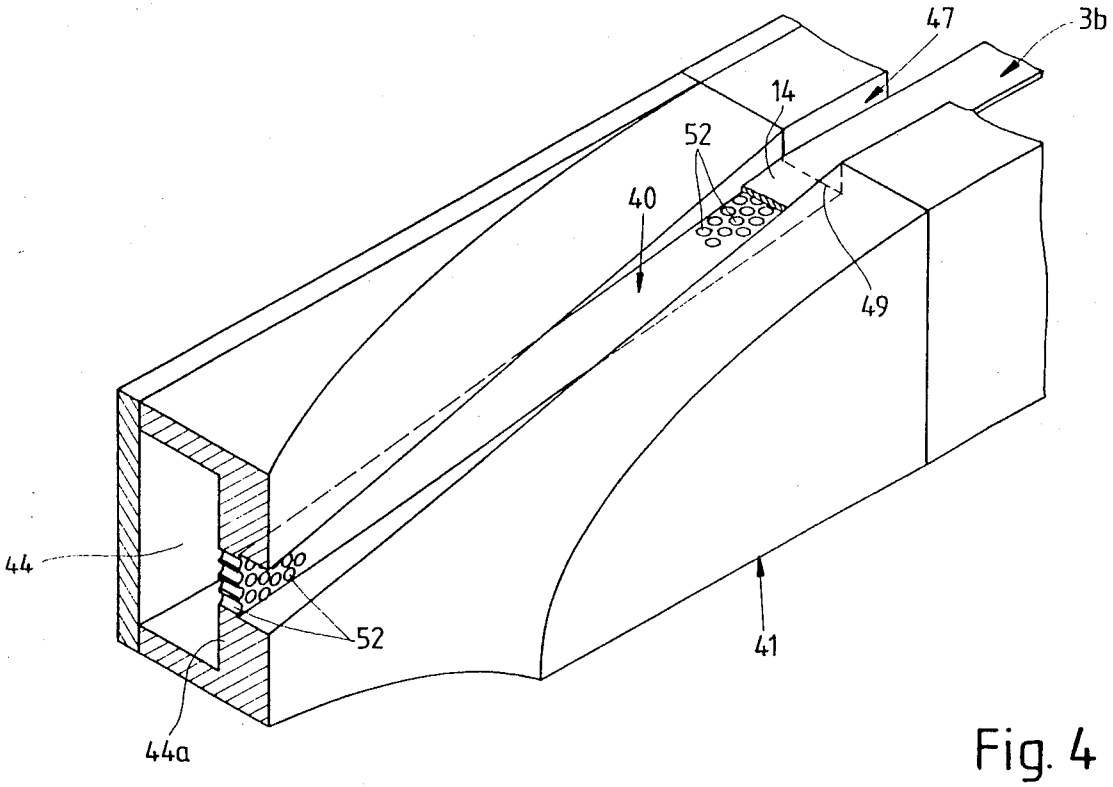
FIG. 4 is an enlarged perspective transverse vertical sectional view substantially as seen in the direction of arrows from the line A—A in FIG. 3.

FIGS. 2, 3 and 4 illustrate the improved stream forming and manipulating apparatus of the cigarette rod making machine in greater detail. The lower reach **3*b* of the foraminous belt conveyor 3 defines an elongated substantially horizontal path wherein the tobacco shreds 38 (which are supplied by the feeding conveyor 2) advance in the direction of arrow 12. The stream 39 is formed (i.e., the stream 39 grows) in a first portion P1 of such path on the flat upstream portion 47 of the lower reach 3*b*. The formation or building of the stream 39 is completed before successive increments or unit lengths of the stream 39 enter a second portion P2 of the elongated path wherein such increments are twisted spirally about the aforementioned axis through an angle of 180 degrees so that the stream is inverted upside down and the orientation of its increments is changed because the twisting of the corresponding intermediate portion 14 of the lower reach 3*b*** is through less than 360 degrees.

The means for twisting the intermediate portion 14 of the lower reach **3*b* of the conveyor 3 through 180 degrees comprises an elongated horizontal channel or trough 41 (see particularly FIG. 4) which contains one or more suction chambers 44 constituting a means for establishing a pressure differential between the opposite sides of the lower reach 3*b* to thus ensure that the particles 38 which are showered by the conveyor 2 adhere to and advance with the exposed side of the portion 47 and thereupon with the exposed sides of the portions 14 and 48 of the lower reach 3*b*. A first portion of the suction chamber 44 is located below the portion 47, a second portion of the suction chamber 44 is adjacent to and twists with the intermediate portion 14, and a third portion of the suction chamber 44 is located at a level above the downstream portion 48 of the lower reach 3*b*. The channel 41 has a flat surface 42 which is adjacent to the underside of the upstream portion 47, a flat surface 43 which is adjacent to the upper side of the downstream portion 48, and a spiral surface 40 which is adjacent to the intermediate portion 14 of the lower reach 3*b*. The direction of travel of tobacco particles 38 with the lower reach 3*b* does not change during transport from the stream building station below the discharge end of the feeding conveyor 2 and the wrapping station at a level above the upper reach of the conveyor 13 i.e., all such particles continue to advance in the direction of the arrow 12. The fully grown stream 39 adheres to the upper side of the upstream portion 47 and to the underside of the downstream portion 48 of the reach 3*b* as a result of inversion during travel with the reach 3*b* along the spiral surface 40 of the channel 41. Thus, the conveyor 2 can shower the particles 38 from above onto the upstream portion 47, and the downstream portion 48 of the reach 3*b* can simply deposit successive increments of the inverted and trimmed stream (filler) onto successive increments of the running web 19 on the conveyor 13. The reference character 46 denotes in FIG. 2 that portion of the channel 41 which is adjacent to the downstream portion 48 of the lower reach 3*b* and which contains the corresponding portion of the suction chamber 44 at a level above the portion 48. It will be noted that the suction chamber 44 (or a composite suction chamber consisting of a series of discrete suction chambers) can extend all the way along that (major) portion of the reach 3*b* which travels in the groove of the channel 41**.

The upper reach **3*a* of the conveyor 3 is not twisted. Twisting of the intermediate portion 14 of the lower reach 3*b*** through 180 degrees can be accomplished by the simple expedient of twisting one end portion of a foraminous belt of finite length through 180 degrees (or by twisting both end portions of such belt through angles together equaling or approximating 180 degrees) before the two end portions of the belt are secured to each other to convert the latter into an endless belt conveyor.

An endless belt conveyor whose upper reach is twisted through 180 degrees is disclosed in the commonly owned copending patent application Ser. No. 672,585 of Alfred Hinzmann filed Nov. 16, 1984. The purpose of the twist in the upper reach of this belt conveyor is to effect or facilitate automatic cleaning of the belt conveyor, i.e., not for the purpose of changing the orientation of (e.g., of inverting upside down) a continuous stream of tobacco shreds or other particulate material. As disclosed in the copending application, twisting of the upper reach of the belt conveyor at a location which is remote from the path for the tobacco stream ensures or promotes expulsion of tobacco dust and other solid particles which could interfere with the establishment of a predictable pressure differential between the opposite sides of that portion of the belt conveyor which attracts and advances the tobacco stream. Moreover, such twisting of the belt conveyor contributes to its longer useful life. Of course, twisting of the lower reach 3b of the conveyor 3 in a manner as shown in FIGS. 1 to 4 also ensures expulsion of solid particles which tend to gather in the pores or interstices of the conveyor material; however, this is a beneficial secondary effect of twisting whose primary purpose is to change the orientation of the stream 39 so that it can be formed by showering the particles 38 from above and that it can be delivered onto the conveyor 13 by simply terminating the application of suction at the pulley 11a of FIG. 2 so that the inverted stream 39 is separated from the lower reach 3b by gravity as well as because the material of the conveyor 3 is caused to travel upwardly (from the pulley 11a toward the pulley 11).

It is normally desirable to clearly define the twisting or spiralling zone (i.e., the intermediate portion 14 of the lower reach 3b of the conveyor 3). In the absence of any measures to the contrary, the twisting zone or station would extend all the way from the pulley 9 to the pulley 11a of FIG. 2. Sharp definition of the twisting zone is accomplished in a manner as best shown in FIG. 3, i.e., one end portion of the twisted surface 40 of the channel 41 defines with the flat surface 42 an acute angle $\alpha_1$ and the other end portion of the twisted surface 40 defines with the surface 43 and acute angle $\alpha_2$. The surfaces 40, 42 define a transversely extending transition zone 49, and the surfaces 40, 43 define a transversely extending transition zone 51. In each of these transition zones, the lower reach 3b has a rather pronounced edge portion extending transversely of the direction which is indicated by the arrow 12, i.e., these edge portions flank the intermediate portion 14 of the lower reach 3b so that the intermediate portion 14 is confined to the portion P2 of the elongated path for the tobacco particles 38 which advance from the path portion Pl toward and onto the web 19 on the upper reach of the conveyor 13. The angles $\alpha_1$ and $\alpha_2$ are greatly exaggerated in FIG. 3 for the sake of clarity; in actual practice, each of these angles is less than 10 degrees and preferably approximately 2 degrees.

FIG. 4 shows approximately one-half of that portion of the channel or trough 41 which causes the lower reach 3b of the conveyor 3 to develop the aforediscussed twisted or spiral-shaped intermediate portion 14. That part of the intermediate portion 14 which is guided by the illustrated portion of the twisted surface 40 of the channel 41 extends along an arc of approximately or exactly 90 degrees. The just mentioned part of the intermediate portion 14 is largely broken away so as to show the ports 52 which are provided in the corresponding wall 44a of the suction chamber 44 in order to draw air from the exposed side of the intermediate portion 14 into the interior of the suction chamber and to thus ensure that the particles 38 which have reached the twisting or inverting station (surface 40 of the channel 41 and the portion 14 of the stretch or reach 3b) continue to adhere to and advance with the exposed side of the reach 3b. FIG. 4 further shows (by broken lines) the transversely extending transition zone 49 between the intermediate portion 14 and the flat or untwisted upstream portion 47 of the lower reach 3b. It will be readily appreciated that the channel 41 is properly rounded in the regions of the transition zones 49 and 51 to thus reduce the wear upon the conveyor 3. As mentioned above, the angles $\alpha_1$ and $\alpha_2$ are relatively small, and this also contributes to a reduction of wear upon the conveyor 3. The intermediate portion 14 of the reach 3b can be twisted in a clockwise or in a counterclockwise direction and through an angle of 180 degrees or through another angle, depending on the positions of the conveyors 2 and 13 with reference to the aforediscussed axis about which the intermediate portion 14 is twisted to partially or completely invert the fully grown stream 39. Furthermore, and if the conveyor 2 is replaced with a duct or another conveyor which delivers tobacco particles against the underside of the reach 3a or 3b of the foraminous conveyor 3 or an analogous conveyor, the conveyor 13 can be disposed at a level above the web 19 and tobacco filler at the wrapping station. In other words, if necessary the improved apparatus can be used to invert a tobacco stream which is delivered to the twisting or inverting station in such position that it is attracted to the underside of a foraminous conveyor and which is to be turned upside down so that its exposed side faces upwardly.

It is equally within the purview of the invention to employ an endless belt conveyor which does not exhibit any twist when it is taken off the pulleys 6, 7, 8, 9 and 11 or 6, 7, 8, 9, 11 and 11a. If such normal or plain (untwisted) conveyor is trained over the aforementioned pulleys, it must be twisted in the region of its lower reach (corresponding to the reach 3b of the illustrated conveyor 3) as well as in the region of its upper reach (corresponding to the reach 3a of the illustrated conveyor 3) so that the plain conveyor is untwisted in the region of its upper reach and twisted in the region of its lower reach or vice versa, depending on the location of the material feeding conveyor.

If the intermediate portion 14 of the illustrated lower reach 3b must be twisted through an angle of less than 180 degrees (e.g., through an angle of approximately 90 degrees), the lower reach 3b must be guided by a second twisted surface of the channel so that the combined twist equals or approximates 180 degrees.

As mentioned above, the improved apparatus can be used with advantage in so-called experimental (laboratory type) machines. However, such apparatus can be used with equal or similar advantage in normal mass-producing cigarette makers or filter rod making machines. Also, the apparatus can form and/or manipulate streams consisting of tobacco particles, fibrous filter material (e.g., acetate fibers) or any other particulate material which can be caused to adhere to one side of a foraminous conveyor.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of producing and manipulating a stream of particulate material of the tobacco processing industry, such as a stream of tobacco particles, comprising the steps of establishing an elongated path; feeding particulate material into a first portion of said path and advancing the material in a predetermined direction longitudinally of said path so that the material grows into an elongated stream; moving the stream longitudinally of said path in said direction; and simultaneously twisting successive increments of the moving stream through a predetermined angle into a spiral in a second portion of said path about an axis which extends in said direction, said second portion being located downstream of the first portion of said path as considered in said direction.

2. The method of claim 1, wherein said angle deviates from 360 degrees so that the orientation of the stream downstream of the second portion of said path departs from the orientation of the stream upstream of said second portion.

3. The method of claim 1, further comprising the step of draping the stream into a web of wrapping material downstream of the second portion of said path.

4. The method of claim 1, wherein said feeding step includes delivering particulate material into the first portion of said path from a level above said first portion.

5. The method of claim 4, wherein said angle equals or approximates 180 degrees.

6. The method of claim 5, further comprising the step of depositing successive increments of the stream onto successive increments of a running web of wrapping material downstream of the second portion of said path.

7. A method of manipulating a deformable stream of particulate material of the tobacco processing industry, such as a stream of tobacco particles, comprising the steps of moving the stream longitudinally along an elongated path in a predetermined direction; and twisting successive increments of the moving stream in a predetermined portion of said path through a predetermined angle into a spiral about an axis which extends in said direction.

8. The method of claim 7, wherein said angle deviates from 360 degrees so that the orientation of the stream downstream of said predetermined portion deviates from the orientation of the stream upstream of said predetermined portion as considered in said direction.

9. Apparatus for producing and manipulating a stream of particulate material of the tobacco processing industry, particularly a stream of tobacco particles, comprising an endless foraminous belt conveyor having an elongated reach; means for driving said conveyor so that said reach advances in a predetermined direction; means for establishing a pressure differential between the opposite sides of said reach; means for twisting an intermediate portion of said reach through a predetermined angle into a spiral about an axis which extends in said direction; and means for feeding particulate material to one side of said reach upstream of said intermediate portion so that the material adheres to said reach due to the establishment of said pressure differential and forms a stream successive increments of which are twisted through said angle by the intermediate portion of said reach.

10. The apparatus of claim 9, wherein said twisting means includes an elongated channel for said reach and said pressure differential establishing means includes at least one suction chamber provided in said channel adjacent to the other side of said reach.

11. The apparatus of claim 10, wherein said one side of said reach faces upwardly upstream of the intermediate portion thereof and said feeding means includes means for supplying particulate material onto said one side.

12. The apparatus of claim 11, wherein said angle equals or approximates 180 degrees so that the stream is inverted upside down during travel with the intermediate portion of said reach.

13. The apparatus of claim 12, further comprising a source of web-shaped wrapping material, means for conveying the wrapping material from said source longitudinally of and below said reach downstream of said intermediate portion, and means for effecting the transfer of the inverted stream from said reach onto the wrapping material.

14. The apparatus of claim 9, wherein said conveyor further comprises an untwisted second reach and said angle equals or approximates 180 degrees.

15. The apparatus of claim 9, wherein said twisting means includes means for defining the boundaries of said intermediate portion with a defined transition between such intermediate portion and the neighboring upstream and downstream portions of said reach.

16. The apparatus of claim 15, wherein said twisting means includes an elongated channel for said reach and said channel has a spiral surface adjacent to the intermediate portion of said reach, said defining means including two substantially flat surfaces provided in said channel, said flat surfaces flanking said spiral surface and defining therewith edges extending substantially transversely of said direction.

17. The apparatus of claim 16, wherein each of said flat surfaces makes an acute angle with the adjacent portion of said spiral surface.

18. The apparatus of claim 9, wherein said twisting means includes a channel receiving at least the major part of said reach and having at least one suction chamber adjacent to the other side of said major part of said reach, said suction chamber forming part of the means for establishing said pressure differential.

19. Apparatus for manipulating a deformable stream of particulate material of the tobacco processing industry, particularly a stream of tobacco particles, comprising a transporting unit defining for the stream an elongated path wherein the stream advances longitudinally in a predetermined direction, said unit having a spiral portion which twists the advancing stream through a predetermined angle about an axis which extends in said direction.

20. The apparatus of claim 19, wherein said transporting unit comprises an endless foraminous belt conveyor having an elongated reach which defines said path, an elongated channel for said reach, and at least one suction chamber provided in said channel adjacent to said reach opposite the stream in said path.

* * * * *